US006948958B1

(12) United States Patent
Kikuchi et al.

(10) Patent No.: US 6,948,958 B1
(45) Date of Patent: Sep. 27, 2005

(54) CONNECTOR IN WHICH AN OPERATING MEMBER FOR DISCONNECTION USED AS A LOCKING MECHANISM

(75) Inventors: Masayuki Kikuchi, Tokyo (JP); Nobukazu Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/856,437

(22) Filed: May 28, 2004

(30) Foreign Application Priority Data

Mar. 17, 2004 (JP) ..... 2004/076960

(51) Int. Cl.[7] ..... H01R 13/62
(52) U.S. Cl. ..... 439/157
(58) Field of Search ..... 439/157–160, 439/328, 372, 153, 341

(56) References Cited

U.S. PATENT DOCUMENTS 5,232,375 A * 8/1993 Todd ..... 439/157
6,869,298 B2 * 3/2005 Latsis ..... 439/157
2004/0005799 A1 * 1/2004 Okabe ..... 439/157
2004/0087193 A1 * 5/2004 Mikhail et al. ..... 439/157

FOREIGN PATENT DOCUMENTS

JP 6208864 7/1994
JP 2003/297482 10/2003

* cited by examiner

*Primary Examiner*—J. F. Duverne
(74) *Attorney, Agent, or Firm*—Collard & Roe, P.C.

(57) ABSTRACT

In a connector having a connector body for being connected to a mating object, an operating member is coupled to the connector body for making the connector body be disconnected from the mating object in a disconnection direction. The operating-member is rotatable relative to the connector body and has an engaging portion for being engaged with the mating object in the disconnection direction when the operating member is angularly offset from the disconnection direction. The connector body has a cam portion which is engaged with the operating member to make the engaging portion be disengaged from the mating object when the operating member is substantially parallel to the disconnection direction.

7 Claims, 6 Drawing Sheets

CONNECTOR IN WHICH AN OPERATING MEMBER FOR DISCONNECTION USED AS A LOCKING MECHANISM

This application claims priority to prior Japanese application JP 2004-76960, the disclosure of which is incorporated herein by reference.

BACKGROUND OF THE INVENTION

This invention relates to a connector having a locking mechanism for locking a connected state between the connector and a mating object.

In order to connect a cable and a board such as a printed wiring board, use has been made of a board connector mounted to the board and a cable connector attached to the cable. By fitting these connectors to each other, an electrically connected state between the cable and the board is achieved.

For example, conventional connectors are disclosed in Japanese Patent Application Publication (JP-A) Nos. H6-208864 and 2003-297482, respectively. Each of the conventional connectors comprises a locking mechanism for locking the above-mentioned connected state and an unlocking mechanism for unlocking the locking mechanism. The unlocking mechanism is activated by manipulating an operating member called a pull tab.

Such a connector with the locking mechanism and the unlocking mechanism is inevitably increased in number of parts although it is designed to be reduced in outer dimension. Further, an operation of removing the connector is troublesome and a connector retaining force of the locking mechanism is insufficient.

SUMMARY OF THE INVENTION

It is therefore an object of the present invention to provide a connector which is reduced in number of parts and is yet capable of improving easiness and convenience in removing the connector and of enhancing a connector retaining force of a locking mechanism.

It is another object of the present invention to provide a connector in which an operating member for releasing connection with a mating object is used as a locking mechanism for obtaining a locked state with the mating object.

It is still another object of the present invention to provide a connection apparatus using the above-mentioned connector.

Other objects of the present invention will become clear as the description proceeds.

According to an aspect of the present invention, there is provided a connector comprising a connector body for being connected to a mating object and an operating member coupled to the connector body for making the connector body be disconnected from the mating object in a disconnection direction, the operating member-being rotatable relative to the connector body and having an engaging portion for being engaged with the mating object in the disconnection direction when the operating member is angularly offset from the disconnection direction, the connector body having a cam portion which is engaged with the operating member to make the engaging portion be disengaged from the mating object when the operating member is substantially parallel to the disconnection direction.

According to another aspect of the present invention, there is provided a connection apparatus comprising a connector and a mating object which are connectable to each other, the mating object having a protruding portion, the connector comprising a connector body for being connected to a mating object and an operating member coupled to the connector body for making the connector body be disconnected from the mating object in a disconnection direction, the operating member being rotatable relative to the connector body and having an engaging portion for being engaged with the protruding portion in the disconnection direction when the operating member is angularly offset from the disconnection direction, the connector body having a cam portion which is engaged with the operating member to make the engaging portion be disengaged from the protruding portion when the operating member is substantially parallel to the disconnection direction.

DESCRIPTION OF THE PREFERRED EMBODIMENT

Figure 1A:
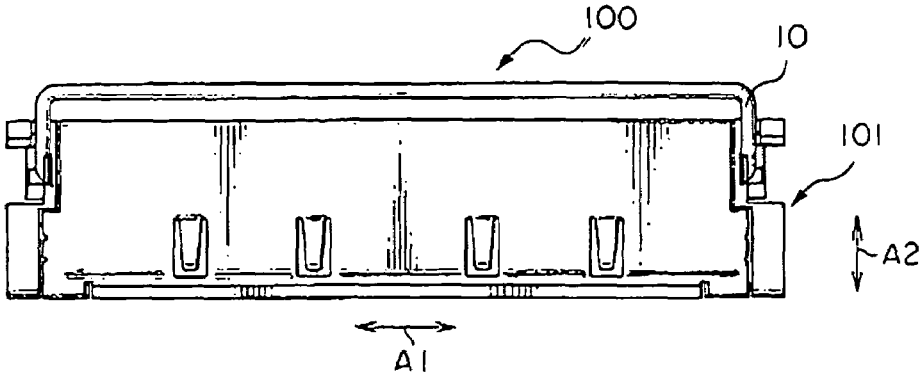
FIGS. 1A to 1D are a plan view, a front view, a bottom view, and a right side view of a plug connector as a connector according to an embodiment of the present invention, respectively.
Figure 1B:
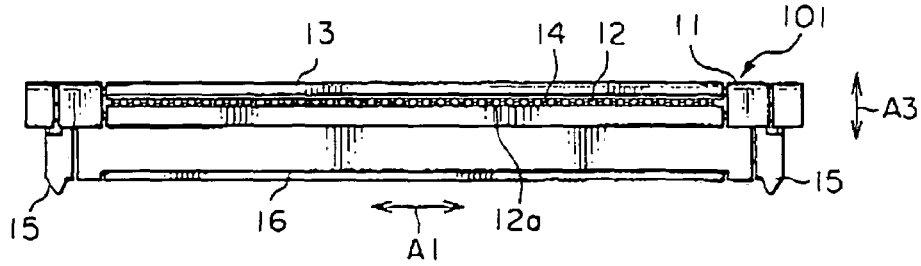
Figure 1C:
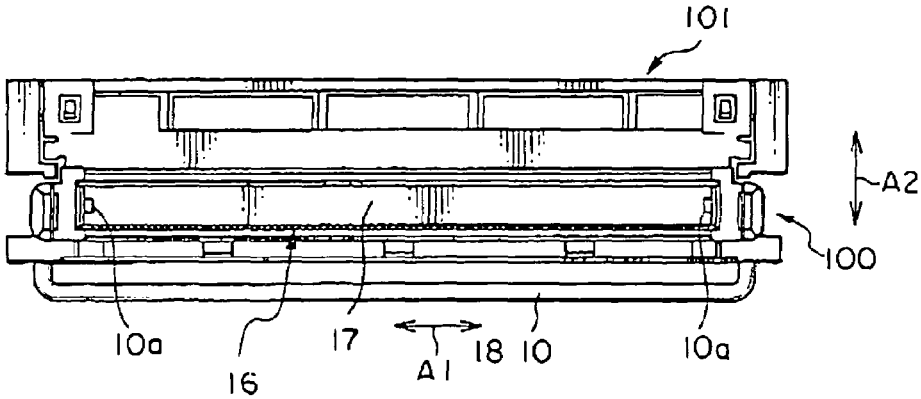

Now, description will be made of this invention with reference to the drawing.

At first referring to FIGS. 1A to 1D, description will be made of a plug connector 100 as a connector according to an embodiment of this invention.

The plug connector 100 comprises a connector body 101 and a pull bar 10 engaged with the connector body 101. The connector body 101 is to be connected to a mating object. The pull bar 10 is adapted for casing the connector body 101 to be disconnected from the mating object in the manner which will far later be described in detail.

Figure 2:
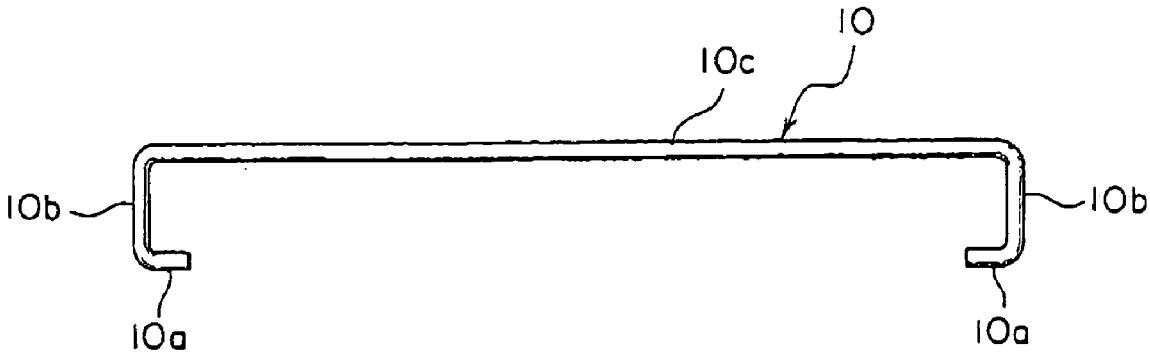
FIG. 2 is a front view of a pull bar used in the plug connector illustrated in FIGS. 1A to 1D.

As shown in FIG. 2 also, the pull bar 10 comprises a generally C-shaped metal rod having a rigidity. The pull bar 10 has a pair of arm portions 10*b* formed at opposite ends thereof and a pair of rotation shafts 10*a* formed at terminal ends of the arm portions 10*b* and faced to each other. The arm portions 10*b* are connected to each other by an operating portion 10*c* and extend along a side surface of the connector body 101. The rotation shafts 10*a* serve as support points of the pull bar 10. The pull bar 10 is made of an elastic material so that the rotation shafts 10*a* can be moved towards and away from each other in an axial direction thereof. As will become clear later, the pull bar 10 serves as an operating member for releasing connection and the rotation shafts 10*a* serve as a part of a locking mechanism.

The connector body 101 comprises an insulator 11 having a generally L-shaped section and extending long in a left and right direction, namely, a first direction A1, and a shell 13 made of a conductive material and surrounding an outer periphery of the insulator 11. The insulator 11 has a cable fitting portion 12 protruding in a front and rear direction, namely, a second direction A2 perpendicular to the first direction A1, and a connector fitting portion 16 protruding towards one side in a third direction A3 perpendicular to the first and the second directions A1 and A2, i.e., downward in FIG. 1D. The cable fitting portion 12 has a fitting hole 12*a* extending inward from a front end thereof. The fitting hole 12*a* is provided with a plurality of conductive contacts 14 which are arranged to be connected to exposed conductive portions of a cable, respectively.

The third direction A3 is divided into downward and upward directions, which will herein be called a connection and a disconnection direction, respectively. It is to be noted that the rotation shafts 11*a* are movable in the axial direction between a first position at which the rotation shafts 11*a* are engaged with a mating object in the disconnection direction and a second position at which the rotation shafts 11*a* are disengaged from the mating object.

The connector fitting portion 16 has a fitting port 17 to be fitted to a board connector which will later be described in detail. On one of inner surfaces of the fitting port 17, a plurality of conductive contacts 18 are arranged in parallel to one another in the widthwise direction. In this embodiment, each of the contacts 14 and each corresponding one of the contacts 18 are integrally formed into a single piece. Alternatively, the contact 14 and the contact 18 may be formed as separate pieces and contacted with each other at their ends.

Figure 1D:
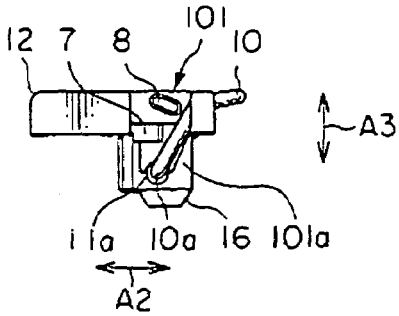

When the arm portions 11*b* of the pull bar 10 illustrated in FIG. 2 are opened or expanded and the rotation shafts 10*a* are inserted into holding holes 11*a* formed on opposite sides of the insulator 11, the rotation shafts 10*a* protrude into the fitting port 17 to be faced to each other. Simultaneously, the pull bar 10 becomes rotatable around the rotation shafts 10*a* with respect to the connector body 101. In FIG. 1D, a rib 7 serves as a cam portion of the plug connector to move each of the rotation shafts 10*a* in the first direction A1 that is perpendicular to the drawing sheet in FIG. 1D.

Figure 3A:
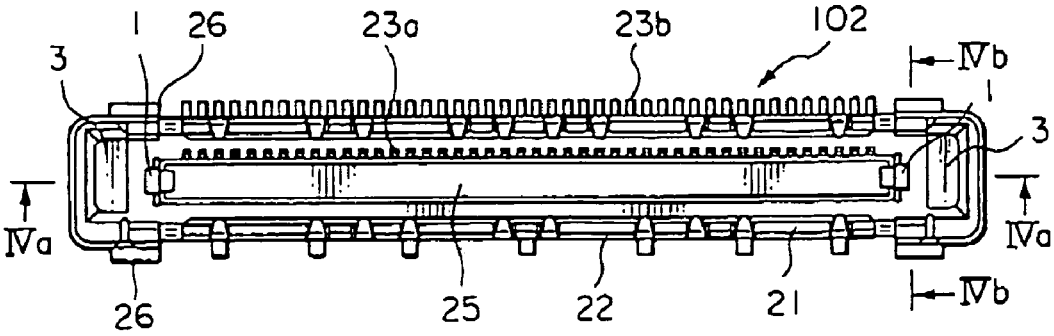
FIGS. 3A to 3C are a plan view, a front view, and a side view of a board connector as a mating connector to be connected to the plug connector illustrated in FIGS. 1A to 1D, respectively.
Figure 3B:
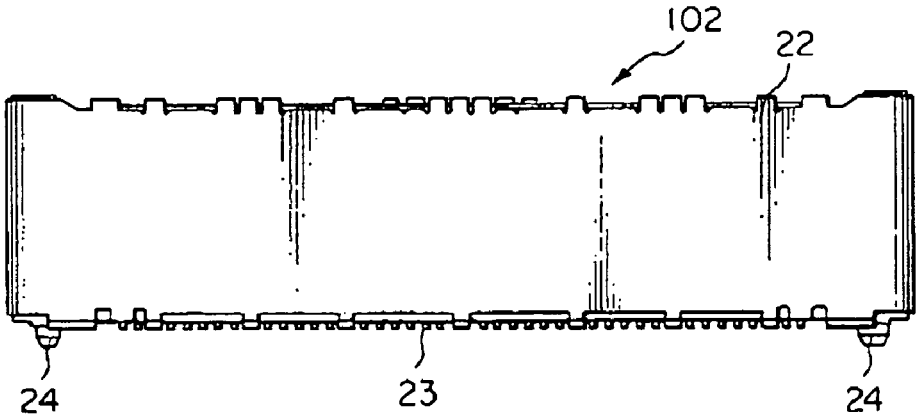
Figure 3C:
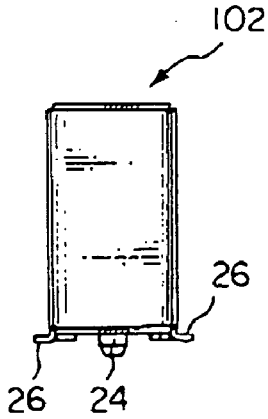

Referring to FIGS. 3A and 3B, description will be made of a receptacle connector or a board connector 102 as the mating object or connector to be connected to the plug connector 100 mentioned above.

The board connector 102 comprises an insulator 21 in the shape of a hollow rectangular cylinder, and a shell 22 made of a conductive material such as a metal and covering an outer peripheral surface of the insulator 21. The insulator 21 has a fitting portion 25 to be fitted to the fitting portion 16 of the plug connector 100. The fitting portion 25 has an outer wall surface equipped with a plurality of contacts 23 each of which comprises an elongated L-shaped metal piece and which are arranged in parallel to one another in the widthwise direction of the board connector 102. Each of the contacts 23 has a contacting portion 23*a* located inside the fitting portion 25 and a terminal portion 23*b* extending outward from a bottom portion of the insulator 21 to be soldered and fixed to a circuit board (not shown). A pair of positioning pins 24 are adapted to be inserted into holes formed in the circuit board. Each of a pair of support portions 26 is formed by cutting and bending a part of the shell 22.

Figure 4A:
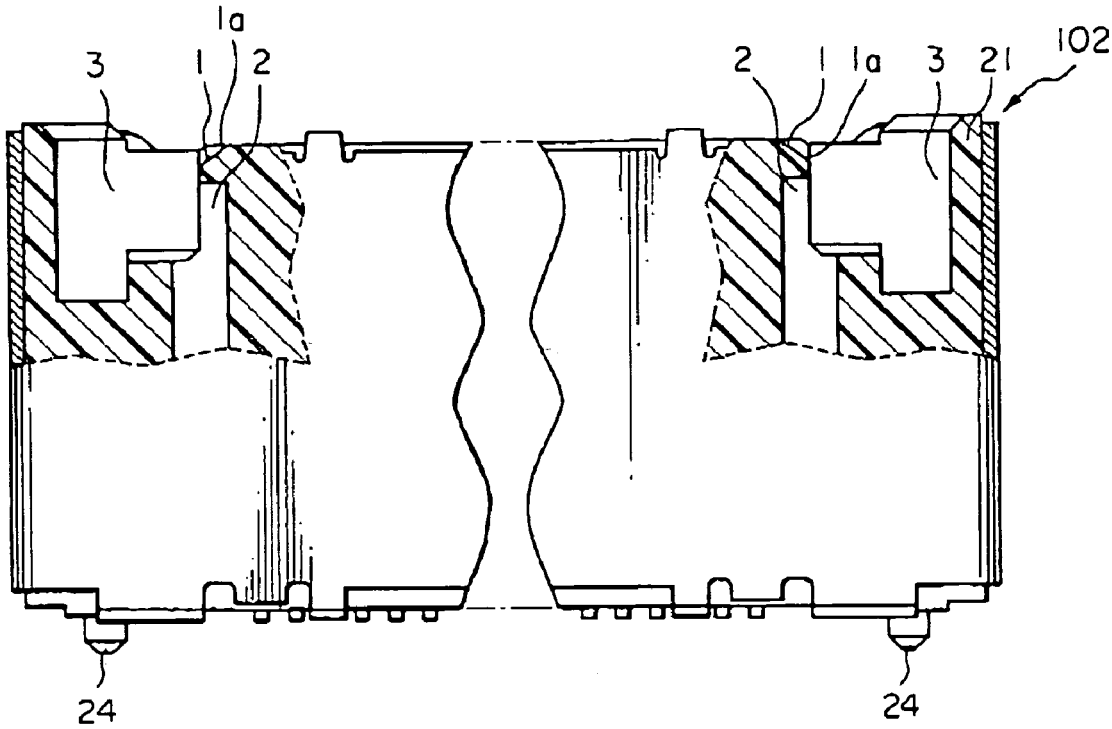
FIG. 4A is a sectional view taken along a line IVa—IVa in FIG. 3A.
Figure 4B:
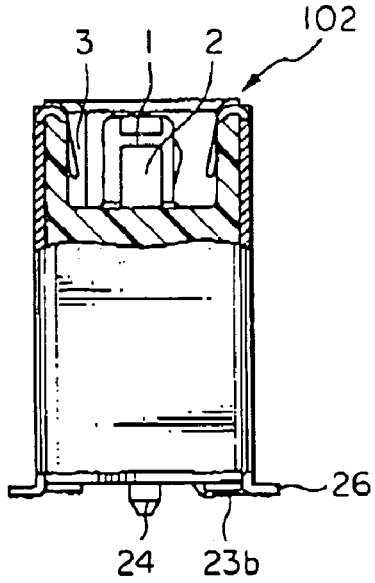
FIG. 4B is a sectional view taken along a line IVb—IVb in FIG. 3A.

Referring to FIGS. 4A and 4B, description of the board connector 102 will continue.

At an upper end of the board connector 102 and on opposite sides in the widthwise direction, a pair of positioning holes 3 each of which has an inverted L-shaped section are formed so as to be fitted to a pair of positioning protrusions 15 formed on opposite sides of a lower portion of the plug connector 100. Inwardly adjacent to the positioning holes 3, a pair of pull bar receiving grooves 2 are formed, respectively. Each of the pull bar receiving grooves 2 is provided with a protruding portion 1 protruding outward in the widthwise direction. The protruding portion 1 has a slant surface 1*a* formed on its upper side and inclined outward in the widthwise direction. The protruding portion 1 is integrally formed with the insulator 21. Alternatively, the protruding portion 1 may be formed integral with the shell 22.

The plug connector 100 in FIG. 1 and the board connector 102 in FIGS. 3A, 3B, 4A, and 4C are fitted to each other to form a connection apparatus or arrangement for connecting a thin-wire coaxial cable, a flexible flat cable, or a flexible printed wiring board with a board.

Figure 5A:
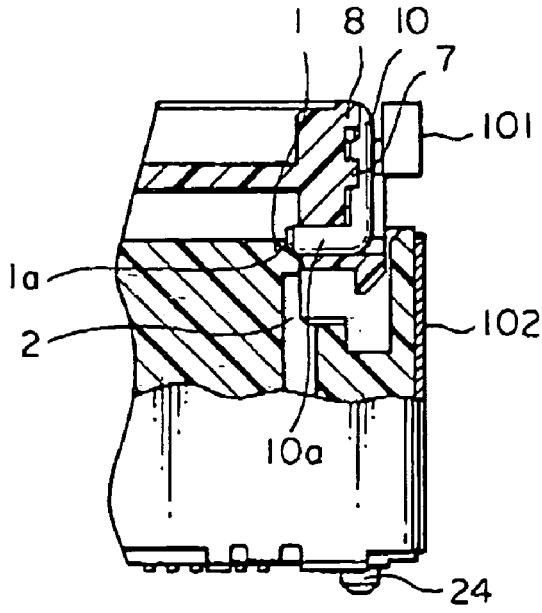
FIG. 5A is a sectional view of a characteristic part alone for describing a state of a locking mechanism during an operation of fitting the plug connector illustrated in FIGS. 1A to 1D and the board connector illustrated in FIGS. 3A to 3C to each other.
Figure 5B:
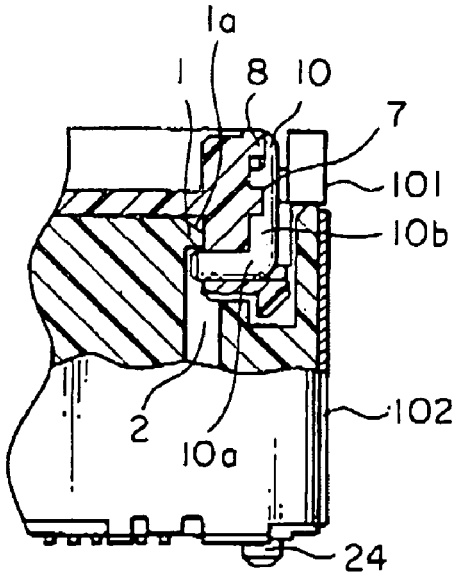
FIG. 5B is a sectional view similar to FIG. 5A after completion of the fitting operation.

Referring to FIGS. 5A and 5B in addition, description will be made of a connector fitting operation of fitting the plug connector 100 and the board connector 102.

Referring to FIG. 5A, upon the connector fitting operation, the positioning protrusions 15 of the plug connector 100 are guided by the positioning holes 3 of the board connector 102 and enter into the board connector 102. Simultaneously, the rotation shafts 10*a* of the pull bar 10 protruding on opposite sides of the interior of the fitting portion 16 of the plug connector 100 are pressed by the slant surfaces 1*a* of the protruding portions 1 to be moved outward. When the connector fitting operation proceeds further in the connection direction and the rotation shafts 10*a* of the pull bar 10 pass across the protruding portions 1 serving as cam portions, the rotation shafts 10*a* are moved inward as illustrated in FIG. 5B due to an elastic restoring force of the pull bar 10 itself. More particularly, a combination of the arm portions 11*b* and the operating portion 11*c* serves as a spring portion urging the rotation shafts 1*a* towards the above-mentioned first position. As a result, the rotation shafts 10*a* are engaged with the protruding portions 1 in the disconnection direction to prevent the plug connector 100 and the board connector 102 from being unintentionally disconnected. In this event, each of the rotation shafts 10*a* serves as an engaging portion. Thus, the plug connector 100 and the board connector 102 are completely fitted and put into a locked state with a high connector retaining force so that the plug connector 100 and the board connector 102 is inhibited from being released. At this time, the pull bar 10 is angularly offset from the disconnection direction and located at a position illustrated in FIG. 1D.

Figure 6A:
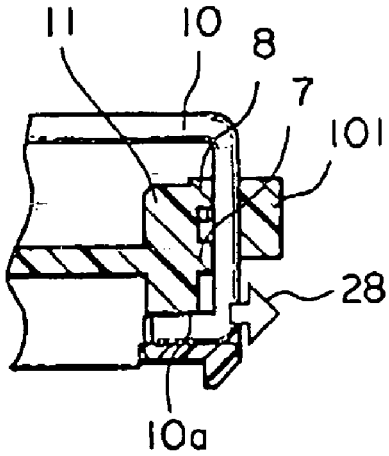
FIGS. 6A and 6B are a sectional view and a right side view of a characteristic part of the plug connector illustrated in FIGS. 1A to 1D for describing an operation of unlocking the locking mechanism, respectively.
Figure 6B:
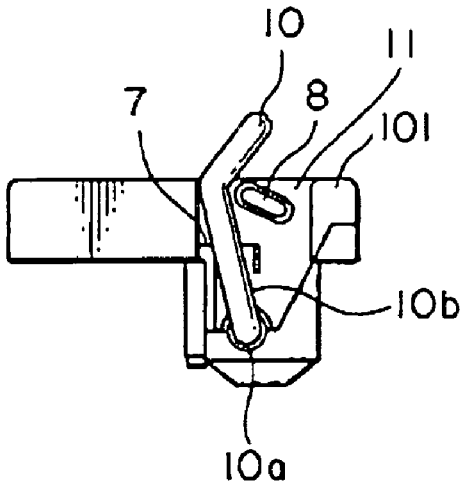

Referring to FIGS. 6A and 6B, description will be made of an operation of releasing or unlocking the locked state. In order to release the locked state, the pull bar 10 is raised. Specifically, the pull bar 10 is rotated around the rotation shafts 10*a* in a counterclockwise direction from the position illustrated in FIG. 1D towards a position illustrated in FIG. 6B. Then, the arm portions 10*b* climb over the ribs 7 so that the rotation shafts 10*a* are moved outward in the widthwise direction as depicted by an arrow 28. In other words, the ribs 7 push the arm portions 10*b* towards the second position in response to movement of the pull bar 10. As a result, the rotation shafts 10*a* are disengaged with the protruding portions 1 in the disconnection direction. More particularly, the locked state is released so as to allow the plug connector 100 and the board connector 102 to be disconnected from each other. Thus, simply by raising the pull bar 10, the plug connector 100 can easily be disconnected from the board connector 102. In this event, the pull bar 10 is held in the raised state by a protrusion 8 formed integral with the insulator 11 of the connector body 101.

The connector or the connection apparatus mentioned above is suitable for connection between a board inside an electronic component and a cable.

While this invention has thus far been described in conjunction with the preferred embodiments thereof, it will be readily possible for those skilled in the art to put this invention into practice in various other manners without departing from the scope of this invention.

What is claimed is:

1. A connector comprising:

a connector body for being connected to a mating object; and an operating member coupled to said connector body for making said connector body be disconnected from said mating object in a disconnection direction, said operating member being rotatable relative to said connector body and having an engaging portion for being engaged with said mating object in said disconnection direction when said operating member is angularly offset from said disconnection direction, said connector body having a cam portion which is engaged with said operating member to make said engaging portion be disengaged from said mating object when said operating member is substantially parallel to said disconnection direction.

2. The connector according to claim 1, wherein said operating member includes, as said engaging portion, a rotation shaft rotatably supported by said connector body, said rotation shaft being movable in an axial direction thereof between a first position at which said rotation shaft is engaged with said mating object in said disconnection direction and a second position at which said rotation shaft is disengaged from said mating object.

3. The connector according to claim 2, wherein said operating member includes a spring portion coupled to said rotation shaft and urging said rotation shaft towards said first position.

4. The connector according to claim 2, wherein said operating member includes an arm portion which is connected to said rotation shaft and extends perpendicular to said rotation shaft along a side surface of said connector body, said cam portion being formed on said side surface of the connector body.

5. The connector according to claim 4, wherein said cam portion pushes said arm portion towards said second position in response to movement of said operation member.

6. The connector according to claim 1, wherein said operating member comprises a generally C-shaped rod having a rigidity, said operating member including a pair of arm portions formed at opposite ends thereof and a pair of rotation shafts formed at terminal ends of said arm portions, said rotation shafts being rotatably supported by said connector body and faced to each other, at least one of said rotation shafts serving as said engaging portion.

7. A connection apparatus comprising a connector and a mating object which are connectable to each other, said mating object having a protruding portion, said connector comprising:

a connector body for being connected to a mating object; and an operating member coupled to said connector body for making said connector body be disconnected from said mating object in a disconnection direction, said operating member being rotatable relative to said connector body and having an engaging portion for being engaged with said protruding portion in said disconnection direction when said operating member is angularly offset from said disconnection direction, said connector body having a cam portion which is engaged with said operating member to make said engaging portion be disengaged from said protruding portion when said operating member is directed to said disconnection direction.

* * * * *